US009869080B2

(12) United States Patent
Shoval

(10) Patent No.: US 9,869,080 B2
(45) Date of Patent: Jan. 16, 2018

(54) CLEANING LIQUID DISPENSER

(71) Applicant: Doron Shoval, Holon (IL)

(72) Inventor: Doron Shoval, Holon (IL)

( * ) Notice: Subject to any disclaimer, the term of this patent is extended or adjusted under 35 U.S.C. 154(b) by 0 days.

(21) Appl. No.: 14/933,014

(22) Filed: Nov. 5, 2015

(65) Prior Publication Data

US 2017/0130438 A1 May 11, 2017

(51) Int. Cl.
*E03D 9/02* (2006.01)
*E03D 9/03* (2006.01)
*E03D 1/33* (2006.01)

(52) U.S. Cl.
CPC ..... *E03D 9/035* (2013.01); *E03D 1/33* (2013.01); *E03D 2009/028* (2013.01)

(58) Field of Classification Search
CPC ..... E03D 9/037
USPC ..... 4/222–233
See application file for complete search history.

(56) References Cited

U.S. PATENT DOCUMENTS 2,243,454 A * 5/1941 Collinge ..... E03D 9/037 137/114
2,913,734 A * 11/1959 O'Hare ..... E03D 9/037 222/319
3,890,657 A * 6/1975 Gray ..... E03D 9/037 4/225.1
4,189,793 A * 2/1980 Williamson ..... E03D 9/037 222/448
4,312,082 A * 1/1982 Murphy ..... E03D 9/037 4/225.1
4,357,718 A * 11/1982 Corsette ..... E03D 9/037 222/453
6,530,094 B1 * 3/2003 Neo ..... E03D 9/031 137/205.5
7,562,399 B2 * 7/2009 Parsons ..... E03D 1/36 137/426
8,099,800 B2 1/2012 Sawalski et al.
2004/0128750 A1 6/2004 Cramer
2005/0133754 A1 * 6/2005 Parsons ..... E03D 1/36 251/129.17
2006/0242754 A1 11/2006 Coppock
2007/0006369 A1 1/2007 Sagy
2007/0151005 A1 * 7/2007 Wilson ..... E03D 9/037 4/227.1
2007/0186335 A1 8/2007 Alexander
(Continued)

FOREIGN PATENT DOCUMENTS

CN 2354675 Y 12/1999
FR 2498656 A1 7/1982
(Continued)

*Primary Examiner* — Lori Baker
(74) *Attorney, Agent, or Firm* — Mark M. Friedman

(57) ABSTRACT

A liquid dispenser is provided including a housing having an inlet port connectable to a liquid container, an outlet port configured to be in fluid communication with toilet tank, and a piston slidably mounted in the housing and selectively displaceable between a suction position in which the piston is displaced away from the inlet port thereby allowing suction of cleaning liquid through the inlet port and an injection position in which the piston is urged towards the outlet port thereby allowing cleaning liquid to be injected through the outlet port, and a float coupled to the piston and configured for displacement thereof to the suction position in response to a rising water level in the toilet tank.

10 Claims, 2 Drawing Sheets

(56) References Cited

U.S. PATENT DOCUMENTS

| | | | | |
|---|---|---|---|---|
| 2009/0178188 | A1* | 7/2009 | Campau | E03D 9/037<br>4/225.1 |
| 2011/0296598 | A1* | 12/2011 | Frey | E03D 9/005<br>4/223 |
| 2016/0249774 | A1* | 9/2016 | Ophardt | A47K 5/1205<br>222/135 |

FOREIGN PATENT DOCUMENTS

| | | | |
|---|---|---|---|
| GB | 2502950 | A | 12/2013 |
| KR | 20120016468 | A | 2/2012 |
| WO | 2013028043 | A2 | 2/2013 |

* cited by examiner

CLEANING LIQUID DISPENSER

FIELD OF INVENTION

The presently disclosed subject matter relates to a cleaning liquid dispenser, in general, and in particular to a cleaning liquid dispenser for dispensing cleaning liquid into a toilet tank.

BACKGROUND

Many devices have been proposed and manufactured for automatic dispensing of cleaning liquids into flush toilets. For example US20040128750 discloses an automatic liquid dispenser dispenses precisely measured amounts of cleaner/deodorizer into a toilets tank through a closed system is further disclosed. The invention consists of a housing that connects between the water supply line and the water supply inlet of a toilets tank and a refillable liquid storage container. The housing is installed in the flow path of the water supply used to fill a toilets tank for flushing. During the filling of the toilets tank the flow of water is directed over an orifice causing a siphon to be created. This siphon compresses a spring loaded ball check allowing liquid cleaner/deodorizer to flow into the water supply filling the toilets tank When the tank is full it contains a predetermined and precisely mixed amount of water and cleaner/deodorizer.

US20060242754 discloses a toilet cleaner dispenser system is centered above an overflow tube and configured to deliver cleanser solution directly to the overflow tube without a hose. A disposable cartridge containing a cleanser tablet is removably coupled to a dispenser housing. Refill water is directed to the housing through an inlet and brought into contact with the cleanser tablet to form a cleanser solution. The cleanser solution exits an outlet of the housing into a receptacle which directs the solution downwardly and directly into the overflow tube. Inlet and outlet water traps prevent fumes from escaping the housing.

SUMMARY OF INVENTION

There is provided in accordance with an aspect of the presently disclosed subject matter a liquid dispenser including a housing having an inlet port connectable to a liquid container, an outlet port configured to be in fluid communication with toilet tank, and a piston slidably mounted in the housing and selectively displaceable between a suction position in which the piston is displaced away from the inlet port thereby allowing suction of cleaning liquid through the inlet port and an injection position in which the piston is urged towards the outlet port thereby allowing cleaning liquid to be injected through the outlet port, and a float coupled to the piston and configured for displacement thereof to the suction position in response to a rising water level in the toilet tank.

The piston can include a sealing head configured to sealingly engage the inner walls of the housing.

The sealing head can be configured to slide in the housing while sealingly engaging an inner walls thereof, such that while the piston is pushed to the suction position the sealing head forms vacuum in the housing about the inlet port, urging thereby suction of cleaning through the inlet port.

The piston can include a spring configured to bias the piston to the injection position.

The inlet port can include a one-way valve configured to allow fluid flow into the housing and to preclude fluid flow out of the housing through the inlet port, and the outlet port can include a one-way valve configured to allow fluid flow out of the housing and to preclude fluid flow into of the housing through the inlet port.

The float can be mounted out of the housing and configured to be lifted in response to buoyancy forces acting thereon and to displace the piston to the suction position therewith.

The piston can include a rod sliding along the housing and protruding out thereof, and a sealing head mounted on one end of the rod, wherein the float is mounted on the other end thereof.

The housing can be configured to be mounted inside a toilet tank, and the float is configured such that when water level in the toilet tank is below a predetermined threshold, the cleaning liquid from the housing is drained.

The amount of cleaning liquid to be discharge in one cycle can be determined by the disposition of the float with respect to the piston.

There is provided in accordance with another aspect of the presently disclosed subject matter a toilet tank having a cleaning liquid dispensing mechanism including a water tank configured to hold therein water; a cleaning liquid container; a cleaning liquid dispenser including a housing having an inlet port connectable to the liquid container, an outlet port being in fluid communication with the water tank, and a piston slidably mounted in the housing and selectively displaceable between a suction position in which the piston is displaced away from the inlet port thereby allowing suction of cleaning liquid from the cleaning liquid container through the inlet port and an injection position in which the piston is urged towards the outlet port thereby allowing cleaning liquid to be injected into the water tank through the outlet port, and a float mounted in the water tank and coupled to the piston and configured for displacement thereof to the suction position in response to a rising water level in the water tank.

BRIEF DESCRIPTION OF THE DRAWINGS

In order to understand the disclosure and to see how it may be carried out in practice, embodiments will now be described, by way of non-limiting examples only, with reference to the accompanying drawings, in which:

FIG. 1C FIG. 1B is a side sectional view of the cleaning liquid dispenser of FIG. 1A, in an injection position thereof, taken along lines A-A.

DETAILED DESCRIPTION OF EMBODIMENTS

Figure 1A:
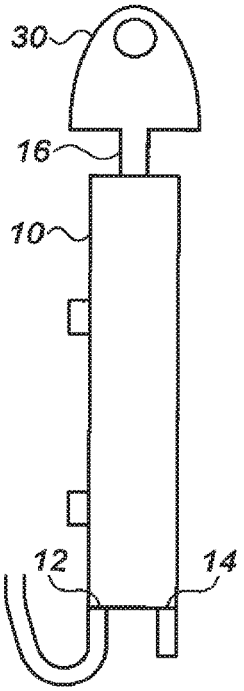
FIG. 1A is a perspective view of a cleaning liquid dispenser in accordance with an example of the presently disclosed subject matter.

FIG. 1A shows a liquid dispenser including a housing 10 configured with an inlet port 12, an outlet port 14, and a piston 16 slidably mounted therein.

The inlet port 12 is configured to be coupled to a pipe connectable to a cleaning liquid container. The outlet port 14 is in fluid communication with a toilet tank such that cleaning liquid from the housing is selectively dispensed into the toilet tank.

Figure 1B:
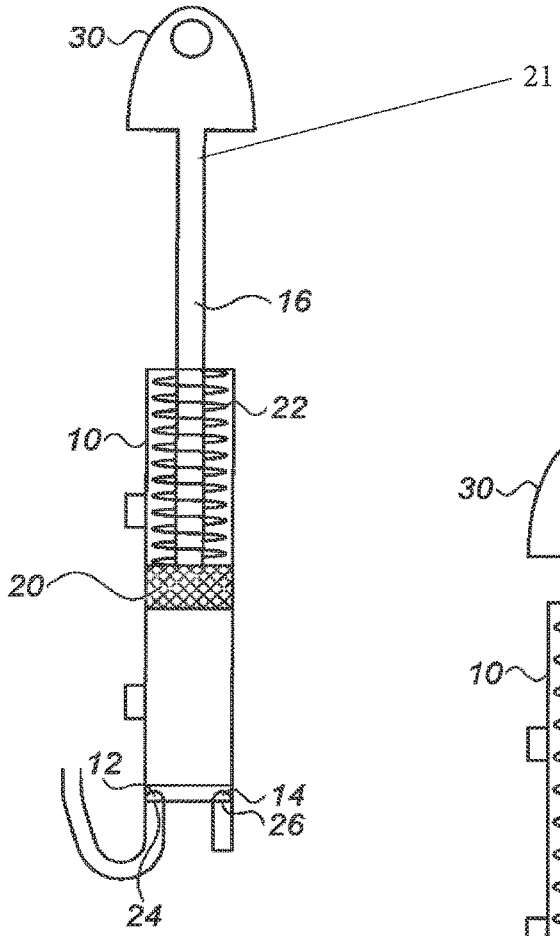
FIG. 1B is a side sectional view of the cleaning liquid dispenser of FIG. 1A, in a suction position thereof, taken along lines A-A.
Figure 1C:
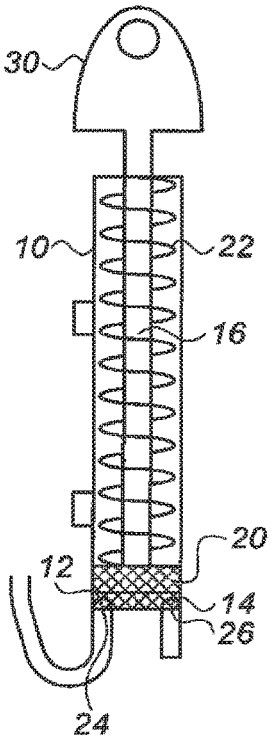
Figure 2:
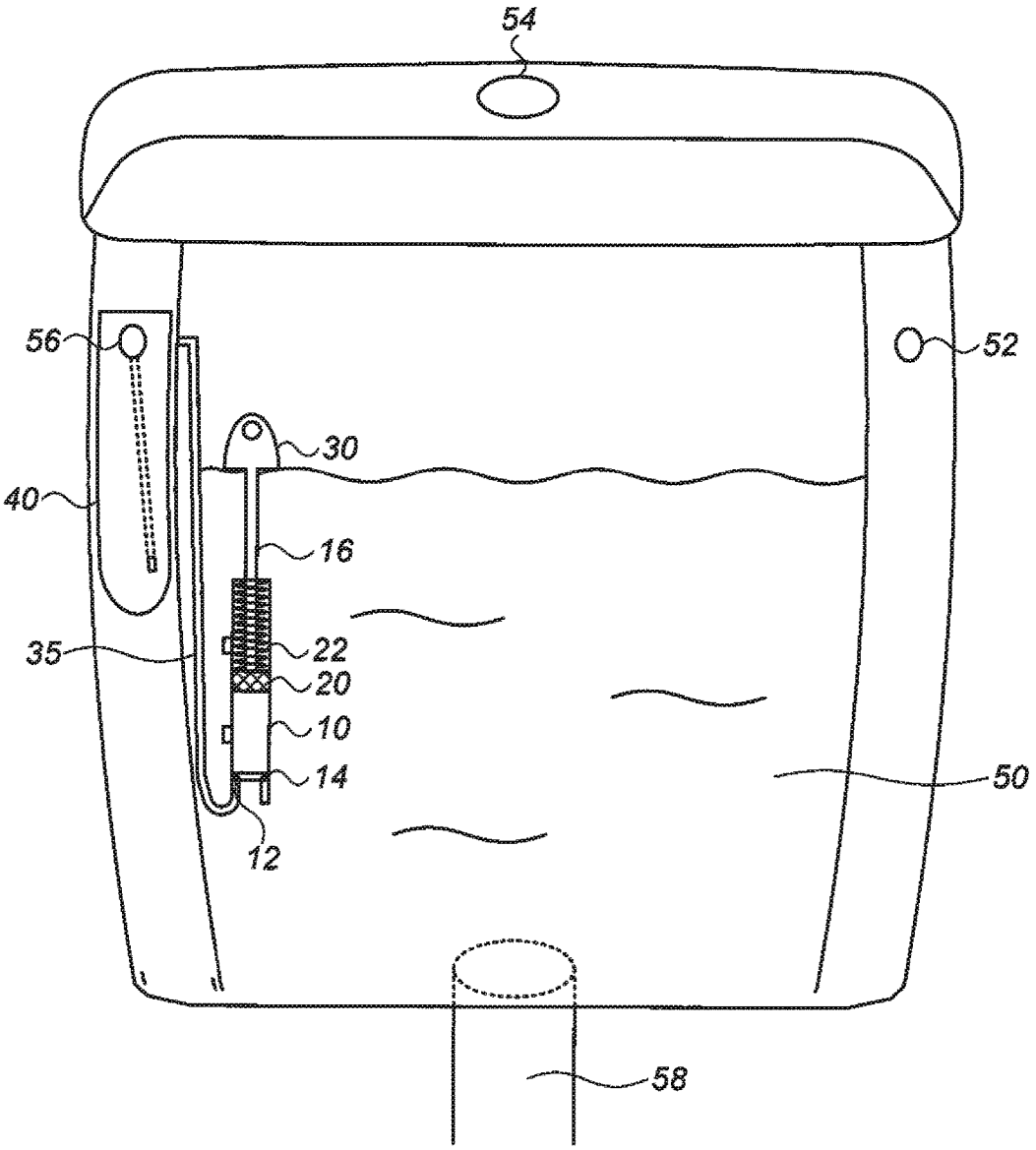
FIG. 2 is a side sectional view of a toilet tank having the cleaning liquid dispenser of FIG. 1A, mounted therein.

As shown in FIGS. 1B and 1C, the piston 16 includes a sealing head 20 and is configured to be selectively disposed in a suction position and an injection position, respectively. In the suction position the piston 16 is disposed such that the sealing head 20 is away from the inlet and outlet ports 12 and 14 allowing fluid flow therethrough and in the injection position the piston 16 is disposed such that the sealing head 20 engages at least the outlet port 14, precluding fluid flow to the toilet tank.

According to an example, the piston 16 includes a spring 22 configured to bias the piston 16 to the injection position. The inlet port 12 includes a one-way valve 24 configured to allow fluid flow into the housing 10 and to preclude fluid flow out of the housing 10 through the inlet port 12. Similarly the outlet port 14 includes a one-way valve 26 configured to allow fluid flow out of the housing 10 and to preclude fluid flow into of the housing 10 through the inlet port 12.

According to an example the sealing head 20 is shaped such that it sealingly engages the inner walls of the housing 10, for example when the housing 10 is a cylindrically shaped housing the sealing head 20 can be a disc shaped head configured with a diameter corresponding to the inner diameter of the housing 10 such that the sealing head 20 slides in the housing while sealingly engaging the inner walls thereof. This way, while the piston 16 is pushed to the suction position away from the inlet port 12, the sealing head 20 forms vacuum in the housing 10 about the inlet port, urging thereby suction of cleaning liquid from a liquid container, through the one-way valve 24.

On the other hand, while the piston 16 is pushed to the injection position towards the outlet port 14, the sealing head 20 applies pressure on the one-way valve 26 of the outlet port, urging thereby flow of cleaning liquid resides in the housing 10 out of the outlet port 14. The one-way valve 24 of the inlet port 12 prevents a back flow of cleaning liquid through the inlet port 12.

According to an example, the piston 16 is coupled to a float 30 protruding out of the housing 10, and configured to be lifted in response to buoyancy forces acting thereon and to displace the piston 16 to the suction position therewith.

According to an example the piston includes a rod 21 sliding along the housing and protruding out thereof such that the sealing head 20 is mounted on one end thereof while the float 30 is mounted on the other end thereof.

Reference is now made to FIG. 4, the liquid dispenser can be mounted inside a toilet tank 50, such that the float is displaced in response to the water level inside the tank 50. According to an example the liquid dispenser is mounted such that the piston 16 is displaced up and down between the suction position and the injection position.

The inlet port is connectable to an inlet tube 35 coupled to a cleaning liquid container 40. The cleaning liquid container 40 can be mounted outside the toilet tank 50, and the tube 35 can extended through a cleaning liquid aperture 56, while water enters then tank through a water aperture 52.

When the user flushes the toilet by pressing the flushing button 54, the flushing mechanism (not shown) is activated, and the water inside the toilet tank 50 are drained through the draining pipe 58 into the toilet bowl (not shown). As the water level inside the tank 50 is below the float 30, no buoyancy forces acting thereon, and the piston 16 is free to displace to the injection position under the forces of the spring 22 acting thereon.

As a result, the sealing head 20 is pushed towards the outlet port 14, applying pressure on the cleaning liquid resides in the housing 10, such that the latter is pushed through the outlet port 14 into the toilet tank. It is appreciated that the cleaning liquid dispenser can be mounted inside the tank 50, such that when the water level therein is below a predetermined threshold, the cleaning liquid from the housing 10 is drained, i.e. the toilet tank 50 is not completely empty yet. This way, the cleaning liquid can be discharged into the water during the flushing process, such that cleaning liquid is mixed with the water allowing a better cleaning of the toilet bowl.

As the toilet tank 50 is filled back with water from the water inlet aperture 52, the water level therein increases, until reaching the float 30. When the buoyancy forces begin acting on the float 30, the float 30 is displaced upwardly, urging the piston to be displaced to the suction position, overcoming the forces of the spring 22. Due to the sealing engagement between the sealing head 20 and the inner walls of the housing 10, vacuum is created inside the latter, urging thereby suction of cleaning liquid from the container 40 via the inlet port 12. At this position, the one way valve 26 of the outlet port 14 prevents water from the toilet tank 50 from entering the housing. It should thus be understood that the one way valve 26 can be configured to withstand the pressure exerted thereon by vacuum formed inside the housing.

It will be appreciated that the suction mechanism of the piston 16 allow mounting the container inside or outside the toilet tank 50 and mounting thereof at any height with respect to the liquid dispenser.

It is appreciated that the container can be replaced with a cartridge holder configured for mounting thereto a cleaning liquid cartridge, such as a disposable container.

It is further appreciated that the amount of cleaning liquid to be discharge in any cycle can be determined by the size of the housing. Alternatively, the amount of cleaning liquid to be discharge in any cycle can be determined by setting the disposition of the float 30 with respect to the piston 16, i.e. if the distance between the float 30 and the piston 16 is shorter the displacement of the piston when the float rises is reduced, and the amount of liquid entering the housing from the container 40 is reduced accordingly.

Those skilled in the art to which the presently disclosed subject matter pertains will readily appreciate that numerous changes, variations, and modifications can be made without departing from the scope of the invention, mutatis mutandis.

The invention claimed is:

1. A liquid dispenser comprising:

a housing having an inlet port connectable to a liquid container, an outlet port configured to be in fluid communication with toilet tank, and a piston slidably mounted in said housing along an axis and selectively displaceable between a suction position in which said piston is displaced away from said inlet port thereby causing suction of cleaning liquid from said liquid container through said inlet port and an injection position in which said piston is urged towards said outlet port thereby allowing cleaning liquid to be injected through said outlet port, and a float coupled to said piston and configured for displacement thereof along said axis to said suction position in response to a rising water level in said toilet tank.

2. The liquid dispenser of claim 1 wherein said piston includes a sealing head configured to sealingly engage the inner walls of said housing.

3. The liquid dispenser of claim 2 wherein said sealing head is configured to slide in said housing while sealingly engaging an inner walls thereof, such that while said piston is pushed to said suction position said sealing head forms vacuum in said housing about said inlet port, urging thereby suction of cleaning through said inlet port.

4. The liquid dispenser of claim 1 wherein said piston includes a spring configured to bias said piston to said injection position.

5. The liquid dispenser of claim 1 wherein said inlet port includes a one-way valve configured to allow fluid flow into said housing and to preclude fluid flow out of the housing through said inlet port, and said outlet port includes a one-way valve configured to allow fluid flow out of said housing and to preclude fluid flow into of said housing through said inlet port.

6. The liquid dispenser of claim 1 wherein said float is mounted out of said housing and configured to be lifted in response to buoyancy forces acting thereon and to displace said piston to the suction position therewith.

7. The liquid dispenser of claim 6 wherein said piston includes a rod sliding along the housing and protruding out thereof, and a sealing head mounted on one end of said rod, wherein said float is mounted on the other end thereof.

8. The liquid dispenser of claim 1 wherein said housing is configured to be mounted inside a toilet tank, and said float is configured such that when water level in the toilet tank is below a predetermined threshold, said cleaning liquid from said housing is drained.

9. The liquid dispenser of claim 1 wherein the amount of cleaning liquid to be discharge in one cycle is determined by the disposition of the float with respect to the piston.

10. A toilet tank having a cleaning liquid dispensing mechanism comprising:

a water tank configured to hold therein water;

a cleaning liquid container;

a cleaning liquid dispenser including a housing having an inlet port connectable to said liquid container, an outlet port being in fluid communication with said water tank, and a piston slidably mounted in said housing along an axis and selectively displaceable between a suction position in which said piston is displaced away from said inlet port thereby causing suction of cleaning liquid from said cleaning liquid container through said inlet port and an injection position in which said piston is urged towards said outlet port thereby allowing cleaning liquid to be injected into said water tank through said outlet port, and a float mounted in said water tank and coupled to said piston and configured for displacement thereof along said axis to said suction position in response to a rising water level in said water tank.

* * * * *